United States Patent [19]

Spronz

[11] 4,444,127

[45] Apr. 24, 1984

[54] INCINERATOR

[75] Inventor: Francis V. Spronz, Rochester, N.Y.

[73] Assignee: Spronz Incinerator Corp., Rochester, N.Y.

[21] Appl. No.: 400,990

[22] Filed: Jul. 23, 1982

[51] Int. Cl.[3] ..... B09B 3/00

[52] U.S. Cl. ..... 110/235; 110/211; 110/212; 110/318

[58] Field of Search ..... 110/235, 238, 208, 210, 110/203, 211, 318, 212

[56] References Cited

U.S. PATENT DOCUMENTS

| | | | |
|---|---|---|---|
| 1,037,676 | 9/1912 | Smith | 110/235 |
| 1,101,925 | 6/1914 | Harris | 110/235 X |
| 1,275,651 | 8/1918 | Borge | 110/211 |
| 1,692,448 | 11/1928 | Jones | 110/235 |
| 2,911,926 | 11/1959 | Kocee | 110/234 X |
| 3,079,878 | 3/1963 | Vargo, Jr. et al. | 110/211 |

FOREIGN PATENT DOCUMENTS

| | | | |
|---|---|---|---|
| 1055314 | 5/1979 | Canada | 110/235 |

*Primary Examiner*—Edward G. Favors
*Attorney, Agent, or Firm*—Shlesinger, Fitzsimmons & Shlesinger

[57] ABSTRACT

The incinerator comprises a dome-shaped furnace containing a fire brick retaining wall, which has an upper edge spaced just beneath the curved ceiling of the furnace, and which divides the furnace into a large primary combustion chamber, and a smaller secondary combustion chamber. A plurality of perforated air-supply tubes are mounted in the primary chamber above a pathological hearth, which is mounted adjacent the bottom of the primary chamber to extend horizontally between the retaining wall and one side of the furnace. Combustion by-products created in the primary chamber pass over the top of the retaining wall, and then downwardly through the secondary combustion chamber and through an opening in the bottom thereof to one side of a discharge duct, which extends beneath the hearth to communicate with a smoke stack that is mounted at the back of a furnace. At least one gas port extends through the opposite side of the furnace to open on the secondary combustion chamber in registry with an opening in the retaining wall, so the flame introduced through this port can pass through the secondary chamber and into the primary chamber to commence combustion in the latter. The sides and rear of the furnace are enclosed in a water jacket which opens to the atmosphere, and which includes means for recirculating the cooling water through a heat transfer device at the exterior of the incinerator.

12 Claims, 3 Drawing Figures

INCINERATOR

BACKGROUND OF THE INVENTION

This invention relates to incinerators, and more particularly to industrial-type incinerators capable of achieving substantially smokeless and orderless combustion of a wide variety of waste products, including rubber and plastics.

Ecological concerns in recent years have led to the passage of very stringent anti-pollution laws, which have set strict limitations on the various materials which can be discharged into the air by industrial incinerators, and the like. Consequently, incinerators of the type disclosed herein must be designed to burn rubbish or waste materials with a minimum discharge of combustion by-products, such as gases, smoke, ash, chemical vapors, and any other matter commonly regarded as a pollutant.

A typical problem encountered in attempting to eliminate or minimize such by-products has been the difficulty in designing an incinerator which is capable of effecting substantially complete combustion of the rubbish being burned, including, as far as possible, any by-products such as gases, vapors, particulate matter, etc. Two of the major factors affecting this complete combustion include the retention time in the combustion area or areas of the furnace, and the quantity of oxygen or air supplied to such areas in order to support complete combustion.

For the most efficient operation of furnaces of the type described, it is desirable that the oxygen supply be neither insufficient nor in excess of that required; and likewise, it is most desirable that the retention time of the combustion by-products in the primary or secondary combustion chambers be minimized, but without deleteriously affecting complete combustion. Furthermore, it is of course important that the furnace be relatively inexpensive to manufacture and operate, and yet be capable of continuous operation for long periods of time without requiring shutdown for maintenance or repair.

It is an object of this invention, therefore, to provide an improved incinerator which includes both primary and secondary combustion chambers, to assist in more complete combustion of waste materials, and improved means for supplying the necessary oxygen and retention time to assure such complete combustion.

Another object of this invention is to provide an improved incinerator of the type which is sealed during use and which incorporates cooling means for its walls to prolong its life, and also to provide more efficient use of the heat of combustion otherwise lost by radiation and conduction through its walls.

Still another object of this invention is to provide an improved incinerator which is relatively simple to manufacture and operate, but which also is particularly efficient in providing complete combustion and satisfactory retention time of the combustion by-products.

Other objects of the invention will be apparent hereinafter from the specification and from the recital of the appended claims, particularly when read in conjunction with the accompanying drawings.

SUMMARY OF THE INVENTION

This incinerator comprises a water-cooled furnace having a dome-shaped ceiling, and being completely lined with fire brick. A hearth extends from one side of the furnace horizontally to a retaining wall or baffle, which extends the length of the furnace adjacent its opposite side. The upper edge of the retaining wall is disposed in closely spaced relation to the curved dome of the furnace and operatively separates its interior into a primary combustion chamber, which is the space located above the hearth, and a secondary combustion chamber formed by the space between th retaining wall and the adjacent sidewall of the furnace. A plurality of perforated air pipes are located in the primary chamber above the hearth, and are connected at the exterior of the furnace to a blower, or the like, which supplies air for combustion. Gases and other by-products from combustion in the primary chamber pass over the upper edge of the retaining wall and downwardly through the second combustion chamber to a radial exhaust duct, which extends through the bottom of the retaining wall to a central exhaust duct that extends longitudinally and centrally of the furnace beneath the hearth, and which communicates at its rear end with a conventional stack that is mounted at the back of the furnace.

The entire furnace is jacketed in an open tank which holds a supply of cooling water around the outside of the furnace. A pair of gas ports extend through the jacket and one side of the furnace to communicate with the secondary combustion chamber, and through at least one opening in the retaining wall with the primary combustion chamber.

In use, combustion is started in the main chamber with air being supplied, as necessary, by the perforated pipes that are connected to the blower. Gases and other combustion by-products pass over the upper edge of the retaining wall and downwardly through the secondary combustion chamber where they can be subjected to secondary combustion by virtue of flames introduced through the gas ports. The gases finally pass out of the bottom of the secondary chamber and longitudinally through the furnace beneath the hearth, thereby to warm the bottom of the hearth before passing vertically upwardly and out of the stack.

The water retained in the cooling jacket can be circulated from the top of the jacket through an auxiliary water tank to transfer heat to the water in the latter tank, before being piped back into the bottom of the cooling jacket.

THE DRAWINGS

DETAILED DESCRIPTION OF THE PREFERRED EMBODIMENTS

Figure 1:
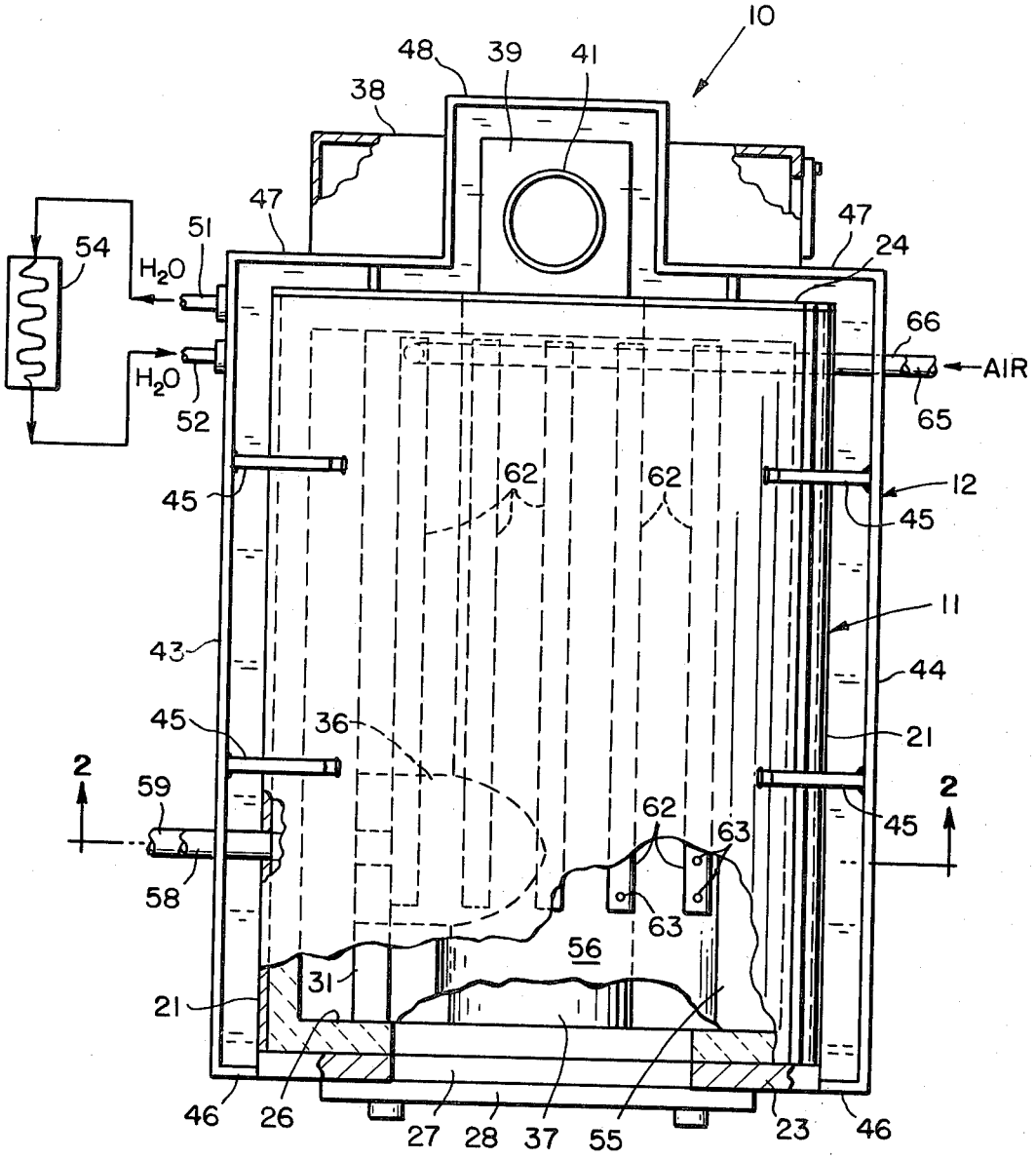
FIG. 1 is a fragmentary plan view of an incinerator made according to one embodiment of this invention, portions of the incinerator being broken away and shown in section, and an associated heat transfer device being illustrated schematically.

Referring now to the drawings by numerals of reference, 10 denotes generally an incinerator comprising a furnace 11, which is surrounded by a water jacket 12.

The furnace 11 comprises an elongate, dome-shaped steel wall 21, which in cross section has an inverted, generally U-shaped configuration. The bottom of the furnace is closed by a rectangularly-shaped steel plate 22, the side edges of which are welded or otherwise secured to the lower edges of plate 21. The forward and rear ends of the furnace 11 are closed by vertically disposed, generally dome-shaped steel plates 23 and 24, respectively, the marginal edges of which are likewise welded or otherwise secured to opposite ends of plates 21 and 22. The entire inside of furnace 11, that is the inside surfaces of plates 21–24, is lined or coated with a thick layer 26 of fire brick.

As used herein, fire brick may be of the type which is made from a castable refractory material which is sold in dry, particulate form, and to which water may be added to provide moldable, mortar-like material which, when dried, becomes a rigid refractory material.

Figure 2:
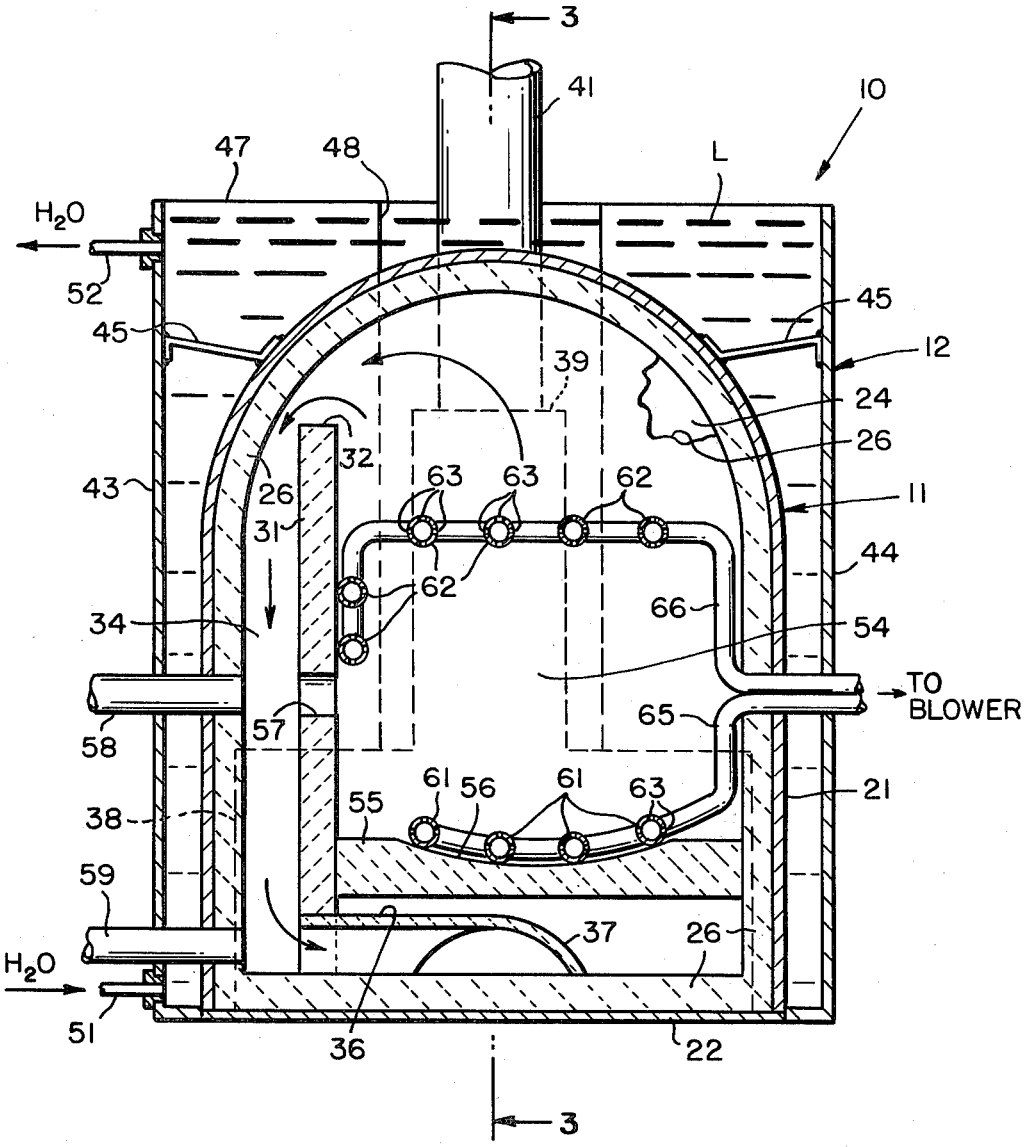
FIG. 2 is a sectional view taken generally along the line 2—2 in FIG. 1 looking in the direction of the arrows.
Figure 3:
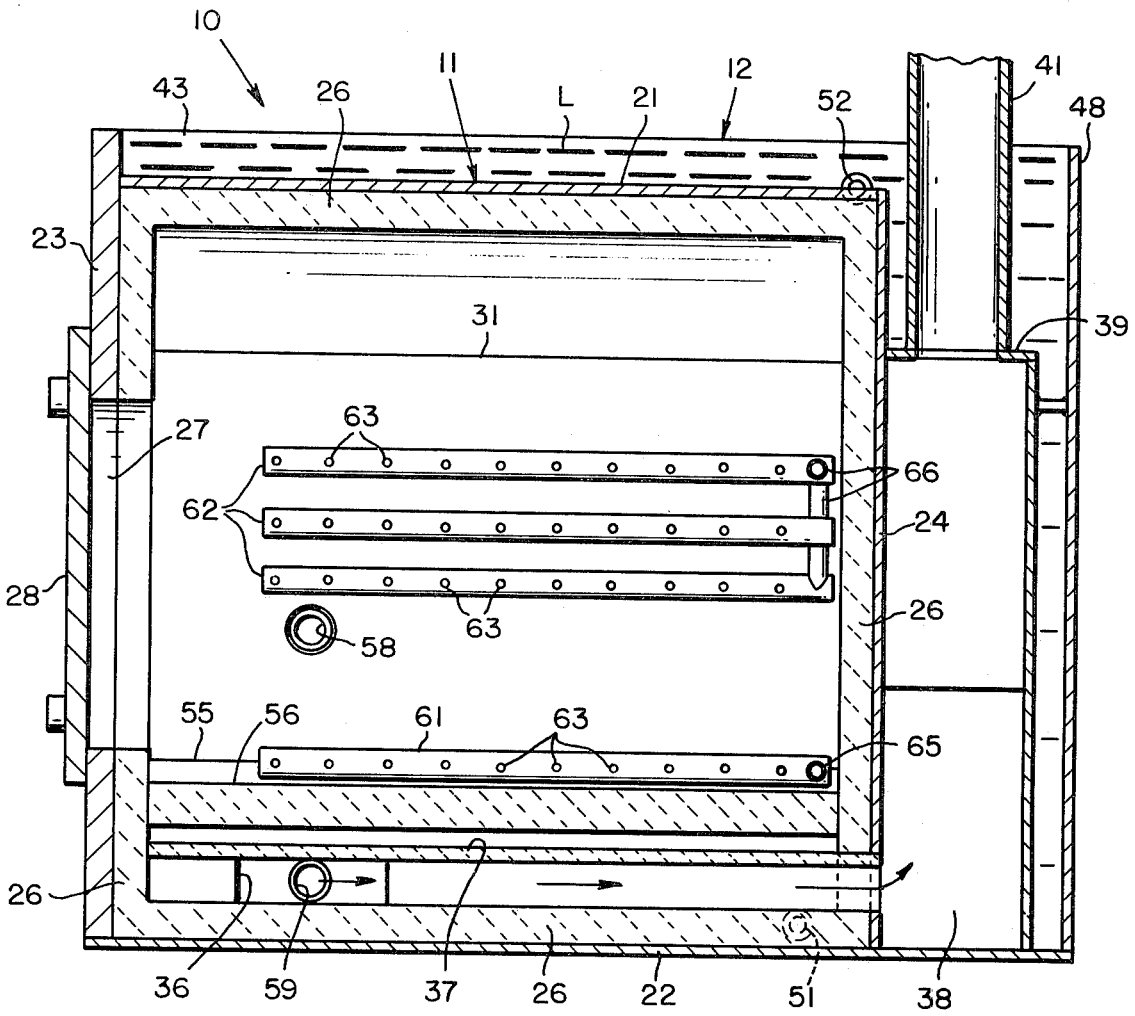
FIG. 3 is a sectional view taken generally along the line 3—3 in FIG. 2 looking in the direction of the arrows.

The front wall 23 of the furnace 11 has therein an access opening 27, which is normally closed or sealed by a conventional door 28 (FIG. 1), when the furnace is in use. Mounted in the furnace to extend between its front and rear walls adjacent one side thereof (the left side as shown in FIGS. 1 and 2) is a vertically disposed retaining wall or baffle 31, which is generally rectangular in configuration. This wall, which can be made from fire brick, or a water-cooled material, if desired, has its upper edge 32 disposed in closely spaced, confronting relation to the curved inside surface of the layer 26 of insulation which covers the curved, dome-shaped ceiling of the furnace.

The space between retainer wall 31 and the adjacent, insulated side wall of the furnace forms a secondary combustion chamber 34, which communicates at its lower end with one end of a radial exhaust duct 36, which is secured in an opening in the bottom of wall 31. At its opposite end duct 36 is secured to, and communicates with, the interior of an elongate exhaust duct 37, which is secured on the insulated floor 22 of the furnace to extend from its front wall rearwardly and centrally of the furnace to an opening (not illustrated) located in the bottom of the rear furnace wall 24. This last-named opening communicates with the interior of a large exhaust plenum or flue 38, which is secured to and projects beyond the rear wall of the furnace beneath the water jacket 11. The base 39 of a conventional smoke stack 41 is secured on the flue 38 in communication with its interior, whereby the secondary combustion chamber 34 communicates through the ducts 36 and 37, and the flue 38 with the stack 41 to enable the furnace exhaust to be discharged to the atmosphere as noted hereinafter.

The ducts 36 and 37, which are arcuate in cross section, may be molded from the above-noted fire brick, and will vary in size depending upon the overall furnace size. Preferably duct 36 is connected to duct 37 adjacent the forward end of the latter so that exhaust gases entering duct 37 will have to traverse substantially the full length of the furnace before reaching the flue 38.

The water jacket 12 may comprise a pair of sheet metal walls 43 and 44 secured by straps 45 in spaced relation to opposite sides of the furnace wall 21. At their forward ends the walls 43 and 44 have flanges 46, which are secured to opposite sides of plate 23; and at their opposite or rear ends walls 43 and 44 are secured by pair of end panels 47, which extend over the top of flue 38, to a generally U-shaped (FIG. 1) wall 48, which surrounds the base 39 of the stack 41. Moreover, as shown in FIG. 2, the upper edges of jacket 12 extend above the top of the furnace 11 to permit a supply of cooling water to reach a level L (FIG. 2) above the top of the furnace.

The cooling water in jacket 12 is adapted to be circulated through a pair of pipes 51 and 52, which are connected to the jacket 12 adjacent it upper and lower edges, respectively. Pipes 51 and 52 are designed to be connected exteriorly of incinerator 10 to a conventional heat exchanger 54 (FIG. 1), whereby warm water supplied by pipe 51 to the exchanger is adapted to be returned from the exchanger by the line 52 to the bottom of jacket 12.

Secured to and extending the full length of the furnace between the retaining wall 31 and the side of furnace 11 remote from the secondary combustion chamber 34 is a rigid, horizontally disposed hearth 55, which can be made from the same type of fire brick as the wall 31 and the furnace liner 26. Hearth 55 has a plane bottom surface spaced slightly above the exhaust ducts 36 and 37, and has in its upper surface a shallow scallop or acruate recess 56 which forms a pathological fire bed capable of retaining liquid waste. The space above the hearth 55 constitutes the primary combustion chamber 54, which communicates over the top of the retaining wall 31 with the secondary chamber 34, and through an opening 57 in wall 31 with the outlet end of a gas port 58. Port 58 extends through the furnace wall 21 and the surrounding jacket 12 to open at its inner end on the secondary combustion chamber 34, and at its outer end on the exterior of the incinerator for connection to a conventional burner nozzle or the like. A similar gas port 59 extends through jacket 12 and the furnace wall 21 beneath the port 58 to communicate at its inner end with the secondary chamber 34 at a point opposite to, and in registry, with the inlet end of the discharge duct 36.

Mounted in the primary combustion chamber 54, and extending longitudinally thereof in spaced, parallel relation, are two sets of perforated tubes or air pipes 61 and 62. These tubes, each of which has therethrough a plurality of spaced ports or openings 63, are similar in construction. Tubes 61, however, are mounted on the upper surface of hearth 55, while the other set of tubes 62 are mounted above the hearth, but beneath the upper edge 32 of the retaining wall 31. Moreover, certain of the upper tubes 62 are disposed in horizontal plane, while others thereof extend along the inside surface of wall 31 as shown more clearly in FIG. 2. Tubes 61 and 62 are closed at their forward ends, and are connected at their rear ends to a pair of plenums 65 and 66, respectively, which extend through the walls 21 and 44 of the incinerator for connection at the exterior thereof to the output of one or more conventional blowers (not illustrated) which may be used for supplying air for combustion to chamber 54.

In use, rubbish or waste material is placed on the hearth 55, and a flame, which is generated by one or more conventional gas burners or the like, is discharged through the gas port 58 (and 59 if desired), and consequently through the opening 57 into the primary combustion chamber. At the same time, air is blown into the chamber through the pipes 61 and 62 so that the rubbish commences to burn. Smoke and other combustion by-products pass upwardly in the furnace into engagement with its curved dome, and then over the upper edge 32 of the retaining wall 31, and downwardly into the secondary combustion chamber 34. Any solids or liquids in the by-products which have been only partially burned, are again subjected to further combustion by the flame entering duct 58, and if desired by the flame discharged into secondary chamber 34 through the gas port 59. After being subjected to the secondary combustion the fumes and byproducts pass through the radial duct 36 and the longitudinally extending duct 37 to the flue 38, from whence they pass upwardly through the stack 41 to the atmosphere.

By controlling the quantity of air introduced through pipes 61 and 62, and the retention time of the combustibles in the primary chamber 54, as by the use of a very narrow opening between the upper edge 32 of the retainer wall 31 and the confronting dome surface of the furnace, it is possible to effect substantially complete combustion within the primary chamber 54, so that the gas and other products which enter at the top of the secondary chamber 34 will be substantially completely burned. However, upon passing through the secondary chamber 34 to the discharge ducts 36 and 37, even further combustion, if necessary, will take place, prior to passage of the gases to the stack 41. By utilizing this rather tortuous course for discharging combustion by-products, the discharge of objectionable pollutants into the surrounding air is minimized. Moreover, by employing the radial duct 36 and exhaust duct 37, which are positioned just beneath the hearth 55, the efficiency of the furnace is substantially increased by virtue of the fact that an extreme amount of heat is generated both beneath and above the hearth, so that any pathological wastes which collect in the recess 56 will be heated from both above and below, thus considerably decreasing the amount of time for such products to vaporized or sublime.

Still another advantage of this incinerator is that the surrounding water jacket 12 substantially prolongs the life of the furnace shell as represented, for example, by the walls 21–24 and the liner 26. This minimizes the shut-down time for repairs to the incinerator. In addition, the heat given off by the furnace is transferred to the water in the jacket 12 so that this heated water in turn can be circulated through pipes 51, 52 to the heat exchanger 54, which therefore can be utilized for other heating purposes, for example to heat rooms or the like. The water jacket 12 is open at its upper end to atmosphere so that the cooling fluid or water within the jacket is at atmospheric pressure. For this reason it is necessary periodically to replenish any cooling fluid which may be lost through vaporization to the atmosphere.

After continuous operation for a period of time, the inside of the furnace 11 tends to reach an extremely high temperature stage, so that by supplying a proper amount of air for combustion through the pipes 61 and 62, the combustion process can continue to take place without the use of any outside flames supplied through the gas ports 58 and 59, except as such flame may be necessary periodically in order completely to consume or burn by-products passing over the top of wall 31.

From the foregoing it will be apparent that the present invention provides a novel and reliable means for incinerating almost any type of product which is capable of being consumed by combustion. The primary combustion chamber is arranged with a tubular manifold system of pipes containing a series of air jets, which introduce the fresh air supply below, above and throughout the primary combustion chamber. In addition, of course, air for combustion can pass over the top of the retaining wall 31 (or through its opening 57) to supply the necessary oxygen for supplemental combustion in the secondary chamber 34, when necessary. The manifolds which supply fresh air to the pipes 61 and 62 are positioned and supplied with air in such a manner as to achieve a pyrolytic or semi-pyrolytic process in the main chamber 54. This combustion process is supported and enhanced by the contoured dome of the furnace 11, which is positioned above the hearth 55, and appropriately baffled by the retaining wall 31 so that an exhaust path for the combustion by-products is long enough and tortuous enough so that the by-products are retained for sufficient time to effect complete combustion thereof in the heating areas of the furnace, including both the primary and secondary chambers, and the exhaust ducts 36 and 37, which if necessary can be further heated by a flame entering the gas port 59. This exhaust flow also creates a sufficient back pressure and enough turbulence in the primary chamber to induce substantially complete combustion in this chamber.

Another factor affecting the desired flow of exhaust gases in the furnace 11 is the fact that the hearth 55 is slightly offset from the center of the furnace, or toward the right of center as illustrated in FIG. 2. This causes the by-products to circulate within the main chamber before being discharged over the top of the retaining wall 32, and assists in the desired retention time within the main chamber.

It is to be understood that the door 28 can be opened during furnace operation to add waste material, or the like; and it is sealed during operation only to the extent that air for combustion may be supplied by pipes 61 and 62. Also, it is not necessary to line furnace 11 with firebrick 26 when the furnace is enclosed in the water jacket 11; and conversely, it is not necessary to use the water jacket 12 when furnace 11 has been lined with firebrick 26. The two have been shown in combination in the drawings merely for purposes of illustration.

While the invention has been described as being particularly suitable for use in commercial incinerators, it will be obvious to one skilled in the art that it can be used wherever incineration is desired; and it will be apparent also that while this invention has been illustrated and described in detail in connection with only certain embodiments thereof, it is to be understood that it is capable of still further modification, and that this application is intended to cover any such modifications as may fall within the scope of one skilled in the art or the appended claims.

What I claim is:

1. An incinerator, comprising a furnace having an arcuate ceiling the axis of which extends longitudinally of the furnace between its front and rear walls, respectively, a retaining wall extending longitudinally of the furnace in spaced, parallel relation to its side walls, and operatively partitioning the furnace interior into primary and secondary combustion chambers, respectively, a hearth extending transversely across said primary chamber between said retaining wall and one side wall of said furnace, means for supplying oxygen to said primary chamber to support combustion of waste material positioned on said hearth, and means connecting said primary chamber to a smoke stack mounted at the rear of said furnace, said means including an exhaust duct extending longitudinally of said furnace beneath said hearth and being sealed intermediate its ends from said primary chamber, said duct opening at one end thereof adjacent the bottom of the secondary combustion chamber as defined by the space between said retaining wall and the other side wall of said furnace, and communicating at its opposite end with said stack, and said retaining wall having the upper edge thereof disposed in spaced, confronting relation to said arcuate ceiling of the furnace, thereby to define a passage connecting the upper ends of said primary and secondary chambers, and having an opening therethrough adjacent its lower edge connected to said one end of said duct, whereby by-products of combustion in said primary chamber may pass downwardly through said secondary chamber and succcessively through said exhaust duct and said stack to the atmosphere.

2. An incinerator as defined in claim 1, wherein said means for supplying oxygen comprises a plurality of perforated pipes mounted in said primary chamber and being connected at one end to plenum means which extends exteriorly of said furnace for connection to a supply of fresh air.

3. An incinerator as defined in claim 1, including means for heating the by-products of combustion as they pass from said primary and through said secondary chamber, including a gas port opening at one end on said secondary chamber and extending at its opposite end through said other side wall of the furnace to the exterior of the incinerator.

4. An incinerator as defined in claim 3, wherein said gas port registers with one end of an opening in said retainer wall, and the opposite end of said opening opens on said primary chamber above said hearth.

5. An incinerator as defined in claim 4, including a second gas port extending through said other wall of said furnace and registering with said duct where the latter opens on said secondary chamber.

6. An incinerator as defined in claim 1, wherein the center of said hearth is laterally offset from the center of said arcuate ceiling of the furnace.

7. An incinerator as defined in claim 1, including a water jacket surrounding the outside of said furnace and having an open, upper end extending above the top of said furnace, and means for circulating cooling water between said jacket and the outside of said furnace.

8. An incinerator as defined in claim 1, wherein said furnace is lined with fire brick, and said retaining wall and said duct are made from the same material as said fire brick.

9. An incinerator, comprising a furnace having an arcuate ceiling the axis of which extends longitudinally of the furnace between its front and rear walls, respectively, a retaining wall extending longitudinally of the furnace in spaced, parallel relation to its side walls, and operatively partitioning the furnace interior into primary and secondary combustion chambers, respectively, a hearth extending transversely across said primary chamber between said retaining wall and one side wall of said furnace, means for supplying oxygen to said primary chamber to support combustion of waste material positioned on said hearth, and means connecting said primary chamber to a smoke stack mounted at the rear of said furnace, said means including an exhaust duct extending longitudinally of said furnace beneath said hearth and opening at one side thereof adjacent the bottom of the secondary combustion chamber as defined by the space between said retaining wall and the other side wall of said furnace, said retaining wall having the upper edge thereof disposed in spaced, confronting relation to said arcuate ceiling of the furnace, thereby to define a passage connecting the upper ends of said primary and secondary chambers, whereby by-products of combustion in said primary chamber may pass downwardly through said secondary chamber and successively through said exhaust duct and said stack to the atmosphere, and said duct comprising a first section extending longitudinally of said furnace and a second section extending at right angles to said first section to open at one end on the interior of said first section and at its opposite end on an opening formed in said retaining wall adjacent the bottom thereof and adjacent the front wall of said furnace.

10. An incinerator, comprising a furnace having a smoke stack mounted on one end thereof, and an access opening in the opposite end thereof for supplying waste to the interior of the furnace, a retaining wall extending between opposite ends of the furnace, adjacent one side of said access opening and operatively dividing the interior of the furnace into first and second combustion chambers which communicate with each other by a space formed between the upper edge of said retaining wall and the ceiling of said furnace, means for supplying oxygen to said chambers for supporting combustion therein, and means including an exhaust duct connected at opposite ends to said second chamber and to said stack, respectively, and operative to cause byproducts of combustion in said first chamber to travel successively through said second chamber and said duct to said stack, said exhaust duct extending longitudinally of the furnace beneath said first chamber to transfer heat by conduction thereto from the by-products passing through said duct.

11. An incinerator as defined in claim 10, including means for retaining cooling water around the outside of said furnace, and means for circulating said cooling water through a heat exchanger located externally of the incinerator.

12. An incinerator as defined in claim 10, including a hearth extending transversely of said other chamber above said duct, and an arcuate ceiling formed in said furnace above said hearth and having a centerline extending between opposite ends of the furnace and in laterally offset relation to the center of said hearth.

* * * * *